US011511295B1

(12) United States Patent
Holly

(10) Patent No.: US 11,511,295 B1
(45) Date of Patent: Nov. 29, 2022

(54) MULTI-PURPOSE SPRAYER

(71) Applicant: Shirley Holly, Roland, AR (US)

(72) Inventor: Shirley Holly, Roland, AR (US)

( * ) Notice: Subject to any disclaimer, the term of this patent is extended or adjusted under 35 U.S.C. 154(b) by 0 days.

(21) Appl. No.: 17/884,605

(22) Filed: Aug. 10, 2022

Related U.S. Application Data

(60) Provisional application No. 63/232,501, filed on Aug. 12, 2021.

(51) Int. Cl.

| | |
|---|---|
| ***B05B 7/04*** | (2006.01) |
| ***B05B 7/28*** | (2006.01) |
| ***B05B 7/24*** | (2006.01) |
| ***B05B 7/12*** | (2006.01) |

(52) U.S. Cl.
CPC ..... *B05B 7/0408* (2013.01); *B05B 7/1209* (2013.01); *B05B 7/2408* (2013.01); *B05B 7/28* (2013.01)

(58) Field of Classification Search
CPC ... B05B 7/0408; B05B 7/1209; B05B 7/2408; B05B 7/28
USPC ..... 239/303–306, 310, 318, 413, 414, 581.1
See application file for complete search history.

(56) References Cited

U.S. PATENT DOCUMENTS

| | | | | |
|---|---|---|---|---|
| 3,720,230 A * | 3/1973 | Stockstill | E03C 1/046 137/564.5 |
| 5,351,892 A * | 10/1994 | Conte | B05B 7/30 239/310 |
| 5,505,382 A * | 4/1996 | Sealy | B05B 7/28 239/318 |
| 6,378,785 B1 * | 4/2002 | Dodd | B05B 7/2443 239/414 |
| 8,480,012 B2 * | 7/2013 | Maclean-Blevins | B01F 25/31242 239/581.1 |

* cited by examiner

*Primary Examiner* — Steven J Ganey
(74) *Attorney, Agent, or Firm* — Fraline J. Allgaier

(57) ABSTRACT

An improved multi-purpose sprayer for separately dispensing a first liquid product and a mixture with a spray head body is presented. The multi-purpose sprayer is operable by manually operating an actuator in a first flow position for selecting the flow of a first liquid product and a second flow position for selecting the flow of the first liquid product and the mixture.

12 Claims, 13 Drawing Sheets

FIG. 15
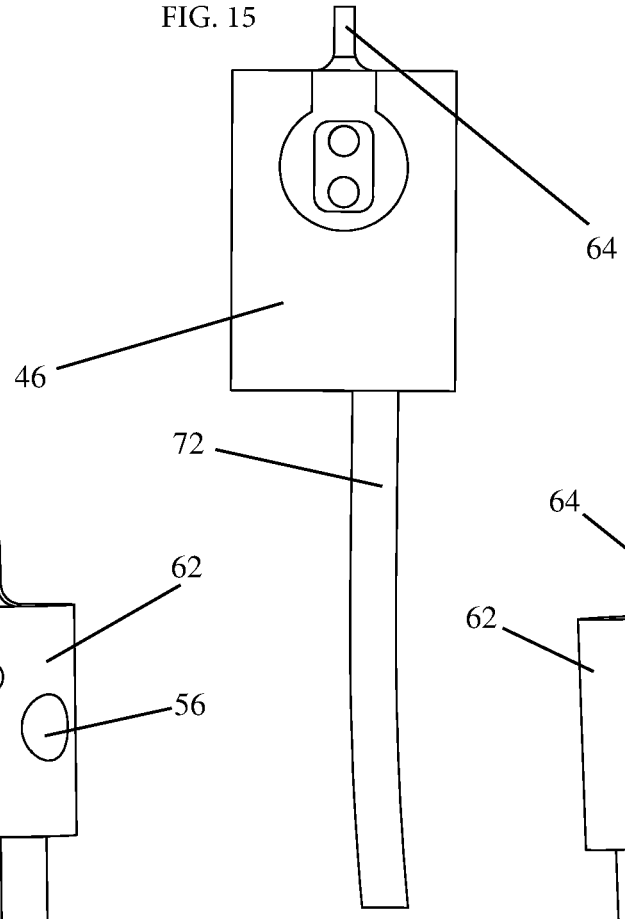
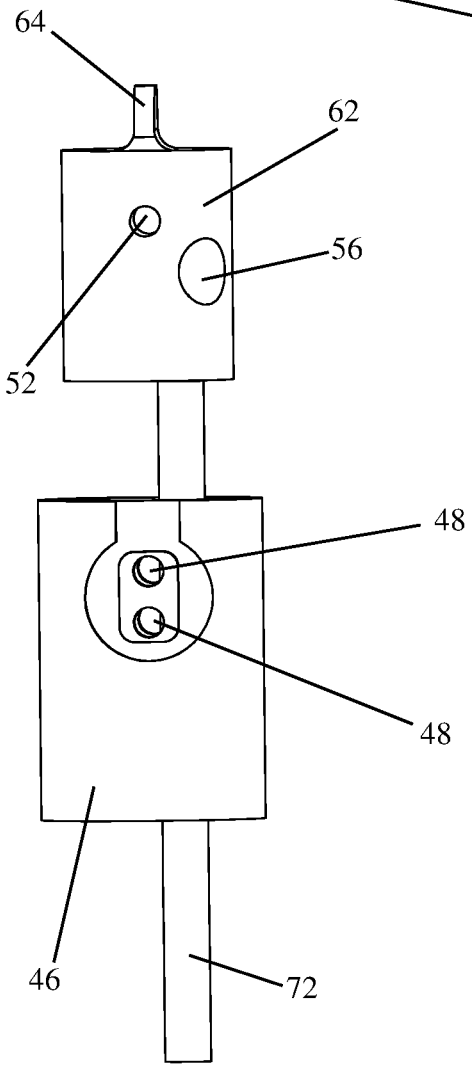
FIG. 16
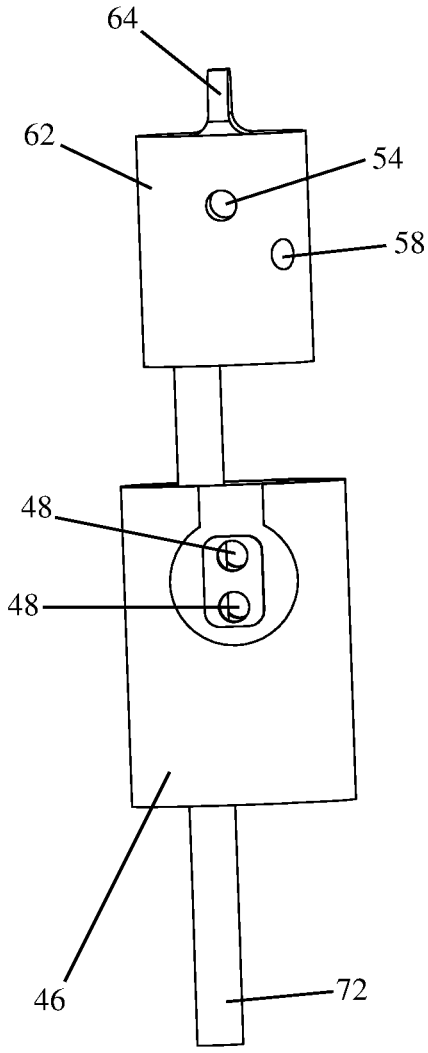
FIG. 17

MULTI-PURPOSE SPRAYER

RELATED APPLICATIONS

This application claims priority of U.S. Provisional Patent Application Ser. No. 63/232,501 filed Aug. 12, 2021.

FIELD OF THE INVENTION

The present invention refers to sprayers and more particularly to an improved multi-purpose sprayer, which in its preferred embodiment separately dispenses a first liquid product or a mixture of a first liquid product and a second liquid product from a novel sprayer head body.

BACKGROUND OF THE INVENTION

A sprayer with a liquid supply attachment has two connections, one of which is connected to the end of a garden hose that serves as a supply of water under pressure to the sprayer and the second of which is connected to a separate product container to be selectively dispensed from the sprayer.

In the typical operation of these sprayers, the flow of water through the sprayer interior creates a venturi effect in the sprayer that draws the product contained in the product container into the flow of water where it is mixed with the water before being discharged from the sprayer.

Sprayers of conventional construction make no provision for multiple nozzles or multiple spraying options. The most commonly used designs comprise a sprayer featuring a fixed purpose use for outflow nozzles that deliver a fixed stream of water or a pre-mixed solution that is produced for a specific container.

Some sprayers are provided with control valves having optional flow features for mixing the contents of separate product containers or for opening the flow of water through a sprayer nozzle while mixing with the contents of the separate product container. These control valves are complex and additional operative parts are often required to combine the mixing operations into a single valve.

In many situations, as for example in gardening or household activities, spray bottles require frequent re-fills of cleaning solutions, mixtures, or chemicals to compensate for an ineffective valve. Over time, a user might require a plurality of sprayers as new spray bottles are quickly replaced.

Therefore, it is desirable to provide a multipurpose sprayer that allows the user to separately dispense a first liquid product or a mixture of liquid products. The present invention provides for an improved multi-purpose sprayer assembly having at least one connection for providing a first liquid product and at least one supply canister for holding a second liquid product to be dispensed with the first liquid product to create a mixture. Therefore, it is an object of the present invention to provide a multi-purpose sprayer having at least one connection being connected to a liquid supply. The multi-purpose sprayer having a spray head body, a passage traversely extending through the spray head body for connection to the liquid supply at an inlet, an outlet for the release of the mixture, a chamber assembly being centrally attached therein, and an actuator for selecting a first or a second flow setting.

To this end, the novel and distinctive features of the disclosure consist of a chamber assembly having a cylindrical exterior housing with a plurality of liquid vent openings for positioning the front and the back through-holes of a first conduit and a second conduit of a valve that is rotatably positioned therein. The first conduit dispensing a first liquid product and the second conduit dispensing a mixture of the first liquid product and a second liquid product.

The multi-purpose sprayer of the present disclosure is further characterized with the following novel features: (1) A chamber assembly of the multi-purpose sprayer having a plurality of liquid vent openings for positioning the front and the back through-holes of a first conduit and a second conduit of a valve that is rotatably positioned therein; (2) A first liquid product entering a first conduit and flowing to a back through-hole thereof for release through an outlet; (3) A second conduit having a constricted front region being connected to a front through-hole through which a first fluid enters and flows to a back region being formed at an acute angle to the constricted first region; (3) A back region of the second conduit being connected to at least one siphon hose having first and second openings and wherein the first opening of the siphon hose is coupled to the back region of the second conduit for introducing the second liquid product into the second conduit thereby creating the mixture of the first liquid product to the second liquid product in the back region. Wherein the mixture flows to a back through-hole connected to the back region thereof for release of the mixture through the outlet; and (4) An actuator being manually actuable in a first flow position for selecting the flow of a first liquid product or a second flow position for selecting the flow of a mixture of the first liquid product with the second liquid product.

SUMMARY

This disclosure is an improved multi-purpose sprayer adapted to release a first liquid product in a first conduit and a second liquid product to be dispensed and combined with the first liquid product to create a mixture. In an embodiment, the multi-purpose sprayer includes a spray head body, a passage for connection to the liquid supply at an inlet, an outlet for the release of the mixture, a centrally attached chamber assembly, and an actuator. A chamber assembly is further provided with an exterior housing having a plurality of liquid vent openings to position the front and the back through-holes of a first conduit and a second conduit of a valve. An over-cap is provided for enclosing the valve and for rotation in the chamber assembly after the manual rotation of the actuator. The actuator is manually actuated to begin a first flow position for selecting the flow of a first liquid product and a second flow position for selecting the flow of the mixture by rotating an over-cap. Indicia displayed on the actuator provide a sequential flow cycle corresponding to the first and the second flow positions.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

Additional advantages and features of the present invention will become more apparent when considered in light of the following specification and drawings.

BRIEF DESCRIPTION OF THE DRAWINGS

The present embodiments are illustrated by way of the figures of the accompanying drawings, which may not necessarily be to scale, in which like references indicate similar elements, and in which:

FIGS. 15-17 illustrate a chamber assembly and the flow positions of the first conduit.

DETAILED DESCRIPTION

Figure 1:
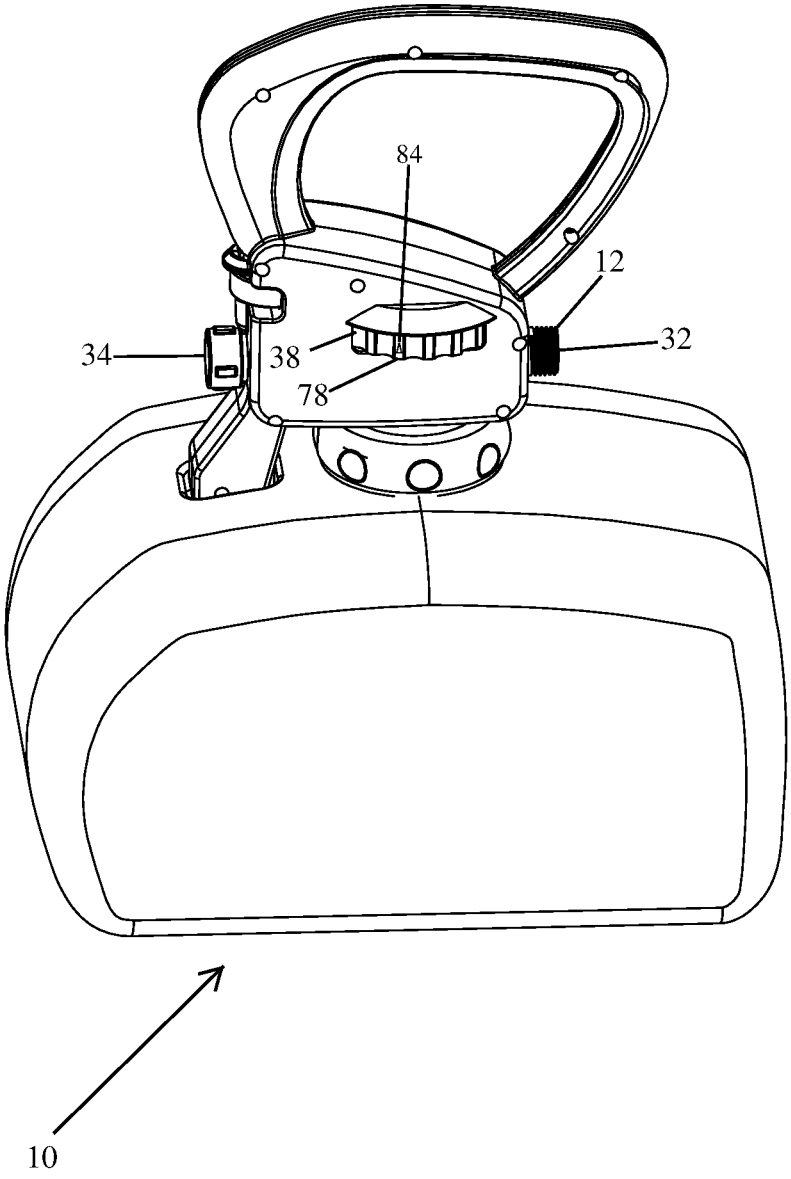
FIG. 1 is a perspective view of an improved multi-purpose sprayer described herein.

The following detailed description is a contemplated mode of carrying out a multi-purpose sprayer 10 and process described herein. Although the multi-purpose sprayer 10 is explained in relation to an illustrated embodiment, it is understood that many possible modifications and variations can be made without departing from the spirit and scope of the disclosure.

Therefore, the multipurpose sprayer 10 may be used to spray various types of products having a plurality of chemical strengths including supplements, liquid fertilizers, diluted fertilizers, insecticides, weed killers, liquid soap products, or the like to provide the cleaning, maintenance, washing, or sanitary needs of a user. There are well know means to supply liquid products including high-efficiency hoses, flexible pipes, siphon hoses, or the like that can be arranged at the inlet 32, outlet 34, and second conduit 51 as provided herein. It is desired that the liquid supply means 24 offer flexibility in design, easy modifications in structure, convenience in use, and efficiency in manufacturing.

It can be appreciated that implementation of a multi-purpose sprayer 10 and process of the present disclosure can include sprayer assemblies capable of attachment to various types of canisters, transfer vessels, tanks, or similar source containers of any desired material, shape, size, or as desired by a manufacturer. The source container can be constructed for placement on the ground or a similar flat surface for a plurality of uses that would include attaching a hose or using a different spray nozzle. A hose can be attached to the inlet 32 and the outlet 34. This arrangement would further eliminate the need for multiple sprayer systems.

Figure 2:
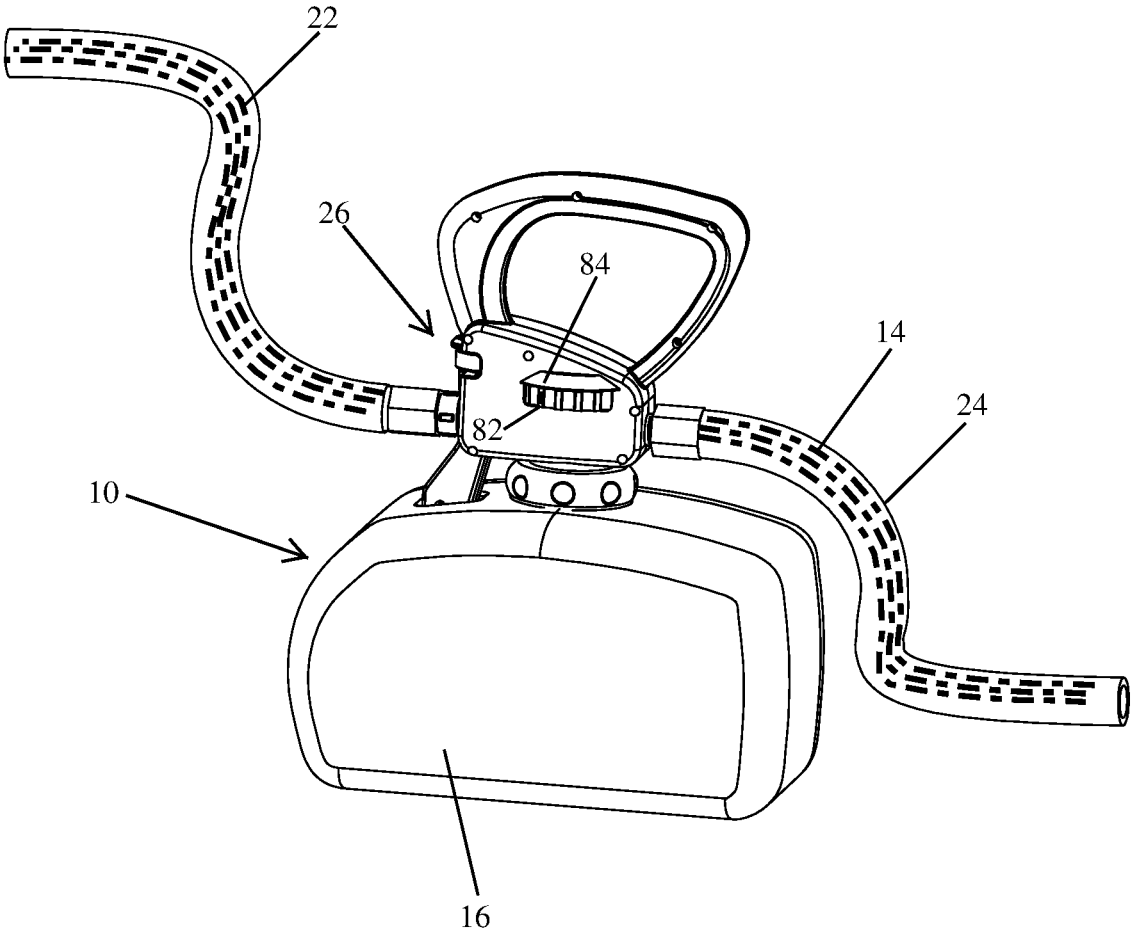
FIG. 2 is a perspective view of an improved multi-purpose sprayer described herein showing the liquid supply provided thereon.
Figure 3:
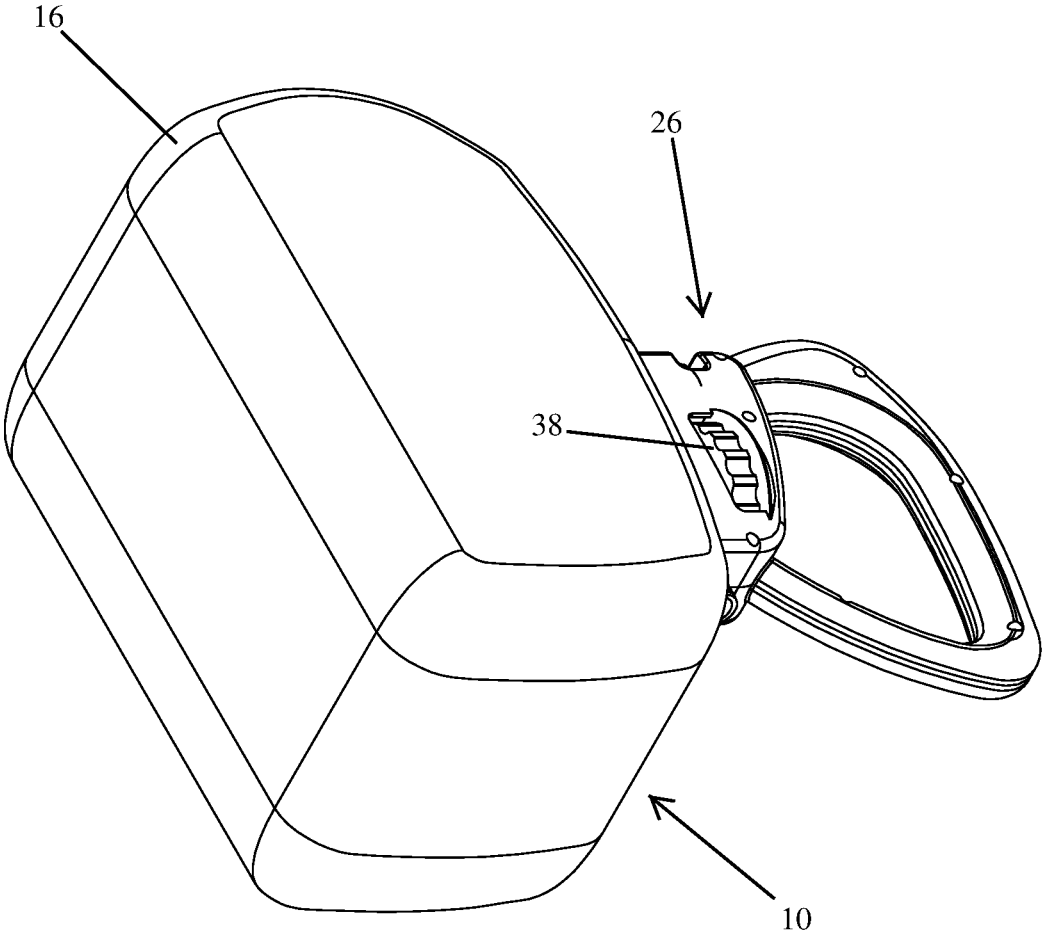
FIG. 3 is a bottom view of an improved multi-purpose sprayer described herein.
Figure 4:
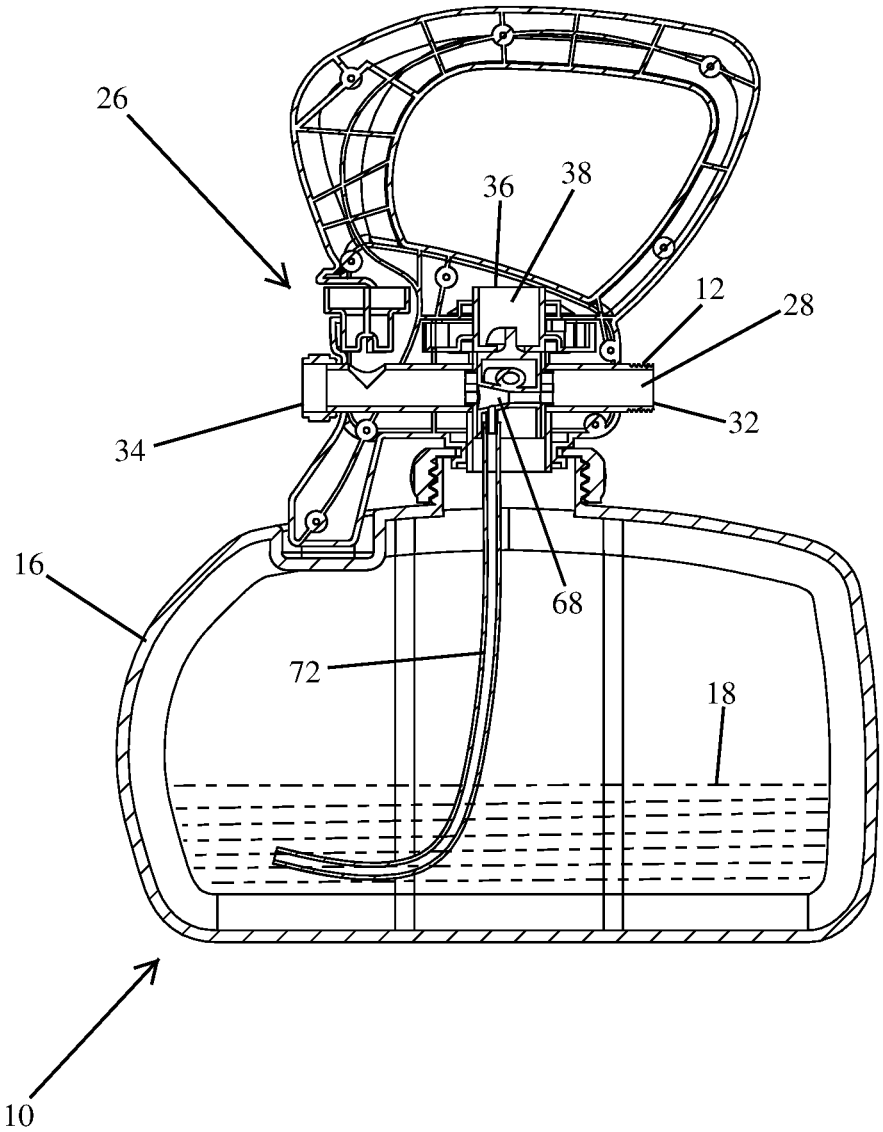
FIG. 4 is a cross-sectional view of an improved multi-purpose sprayer according to an embodiment described herein.
Figure 5:
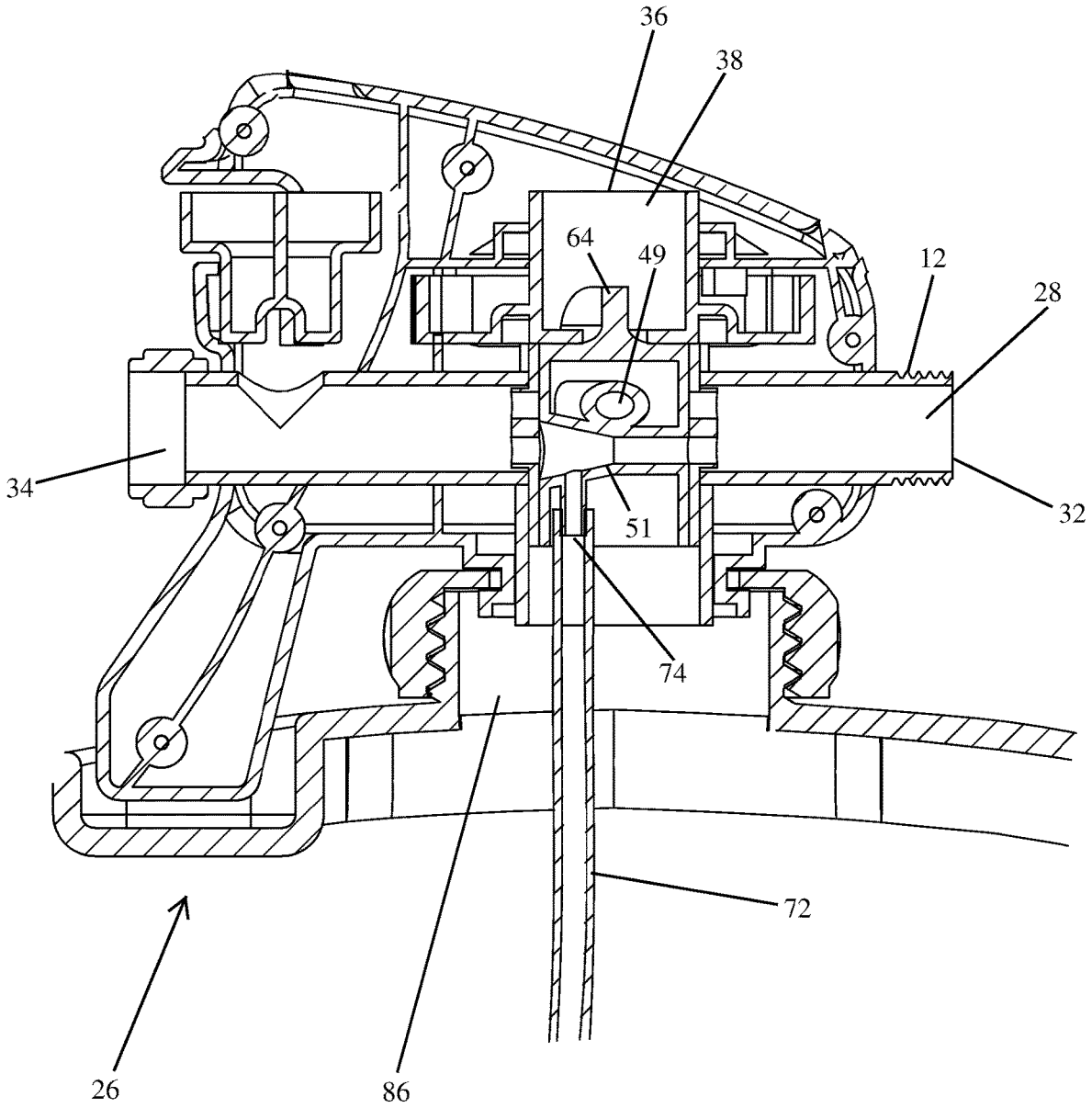
FIG. 5 is a cross-sectional view of the spray head body according to an embodiment described herein.
Figure 6:
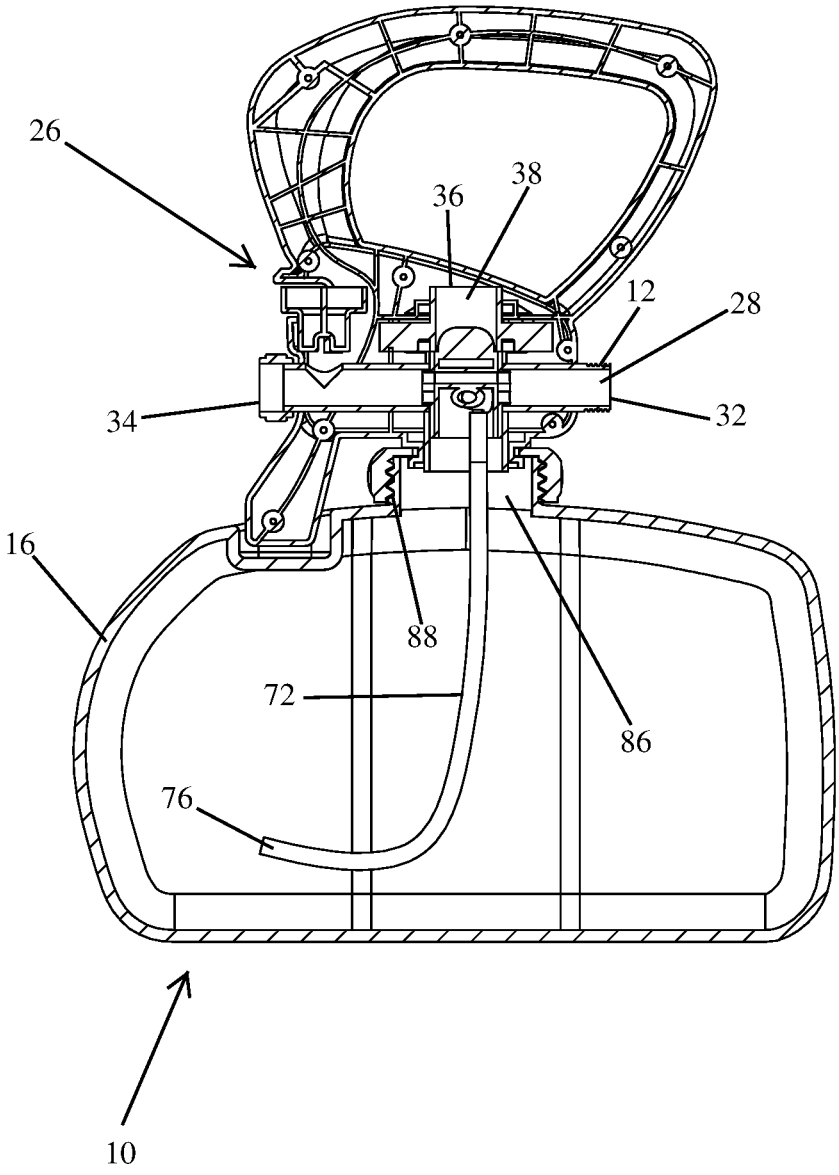
FIG. 6 is a cross-sectional view of an improved multi-purpose sprayer according to an embodiment described herein.
Figure 7:
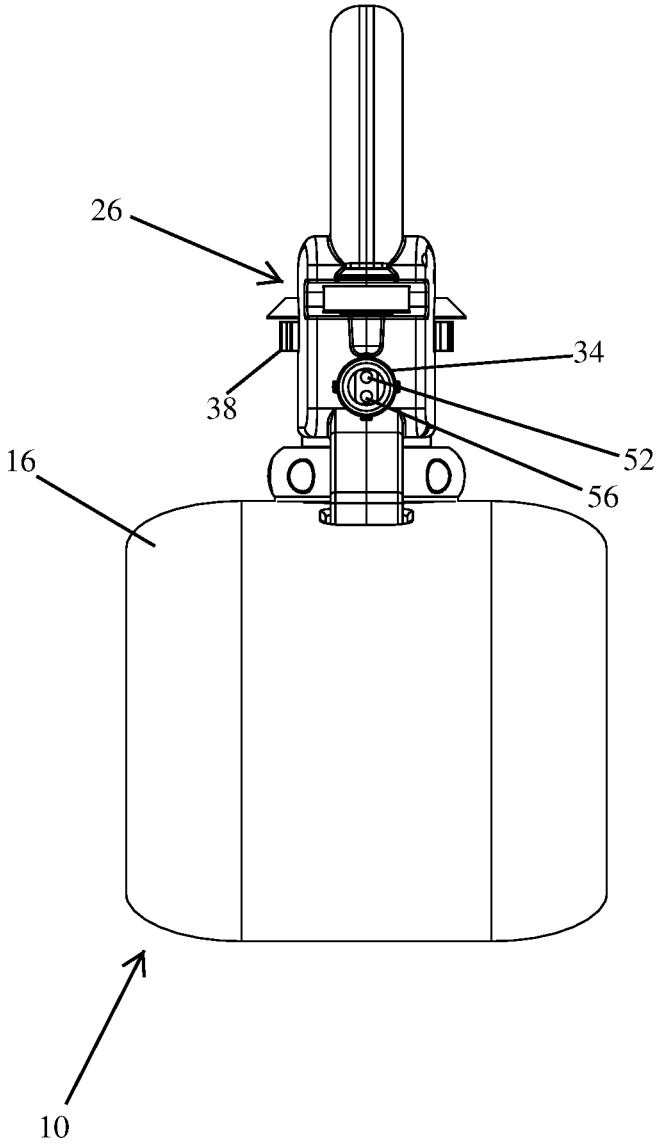
FIG. 7 is a front view of an improved multi-purpose sprayer showing the first and the second conduit.
Figure 8:
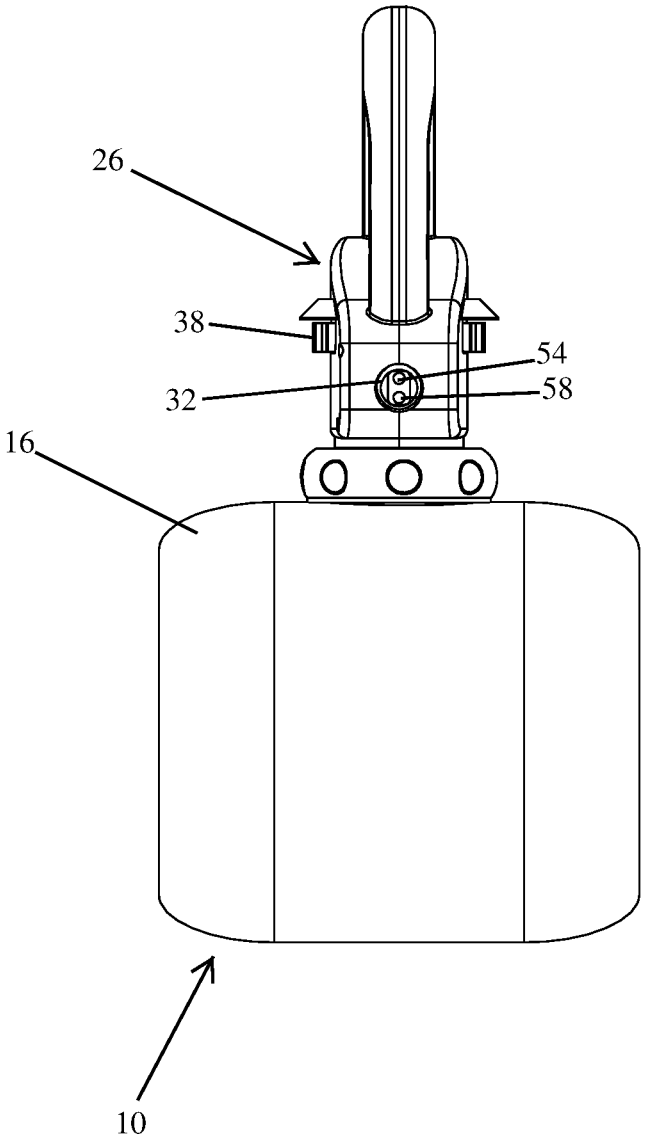
FIG. 8 is a rear view of an improved multi-purpose sprayer showing the first and the second conduit.
Figure 9:
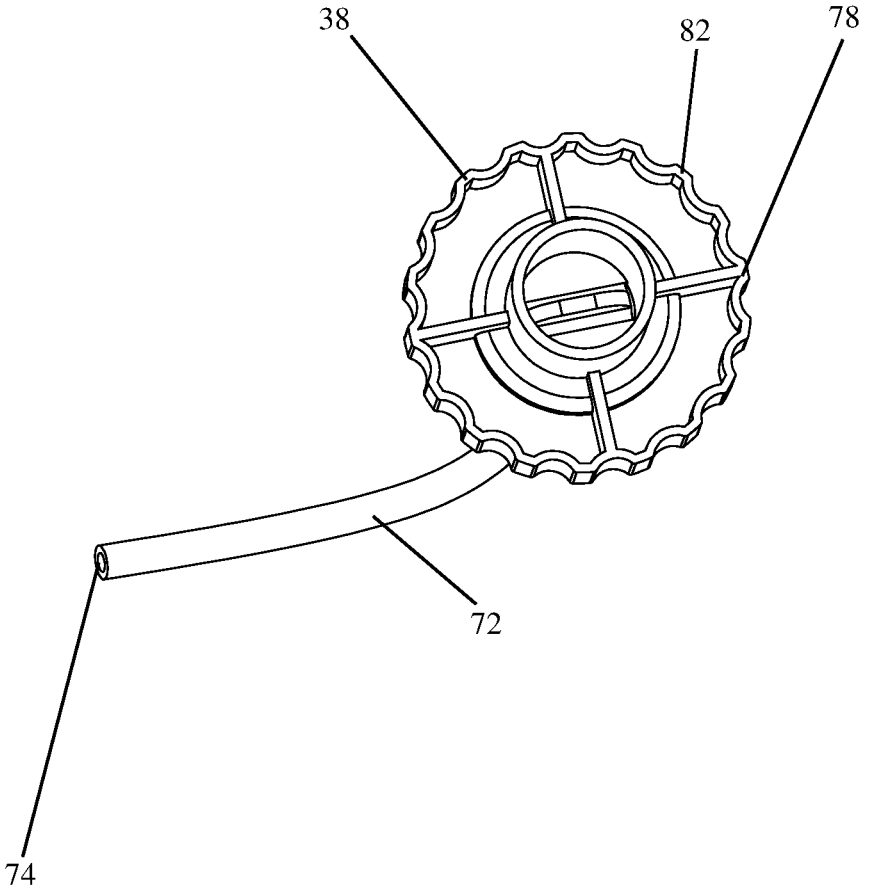
FIG. 9 is a bottom view of an actuator showing the first and the second flow positions provided therein.
Figure 10:
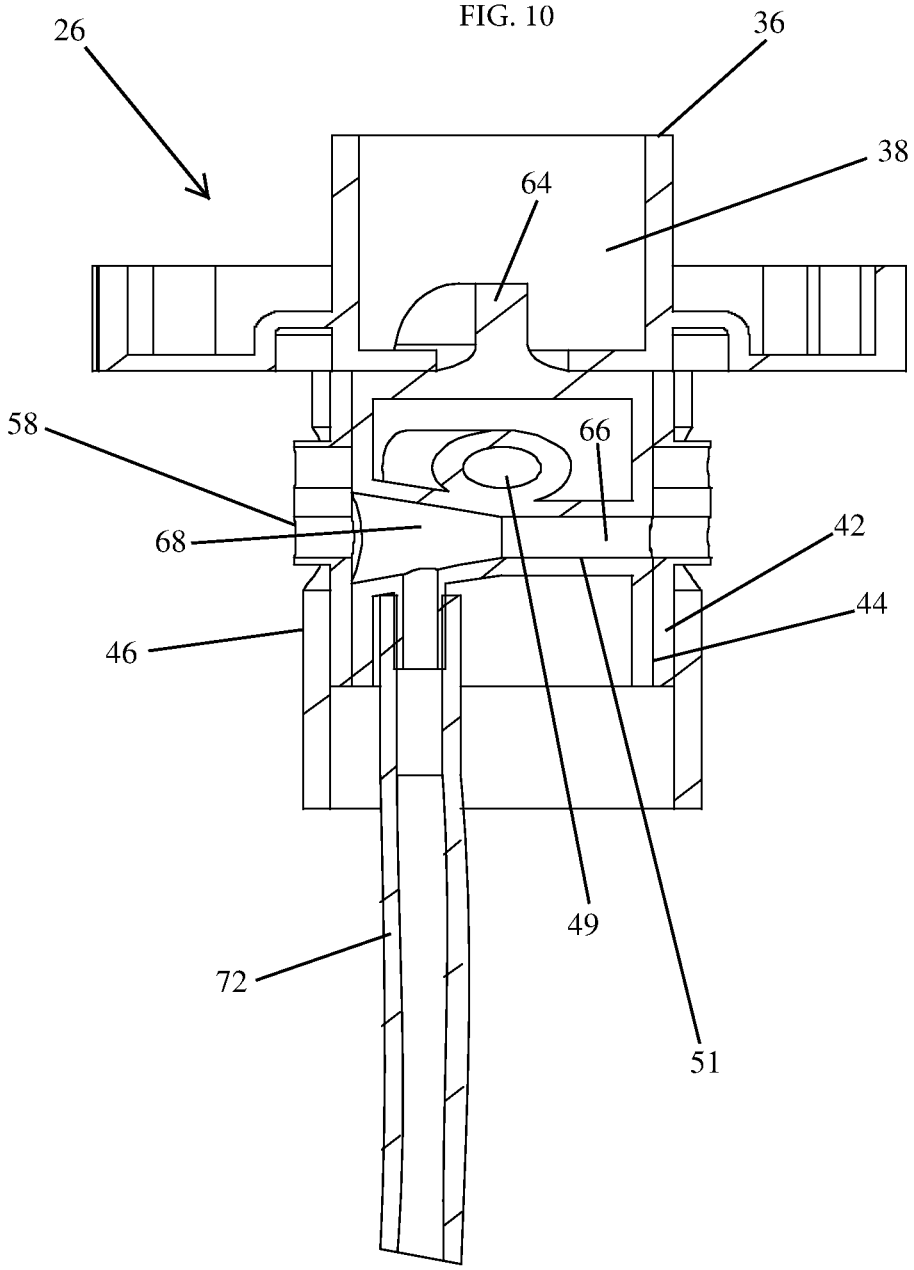
FIG. 10 is a cross-sectional view of a chamber assembly showing the flow position of the first conduit.
Figure 11:
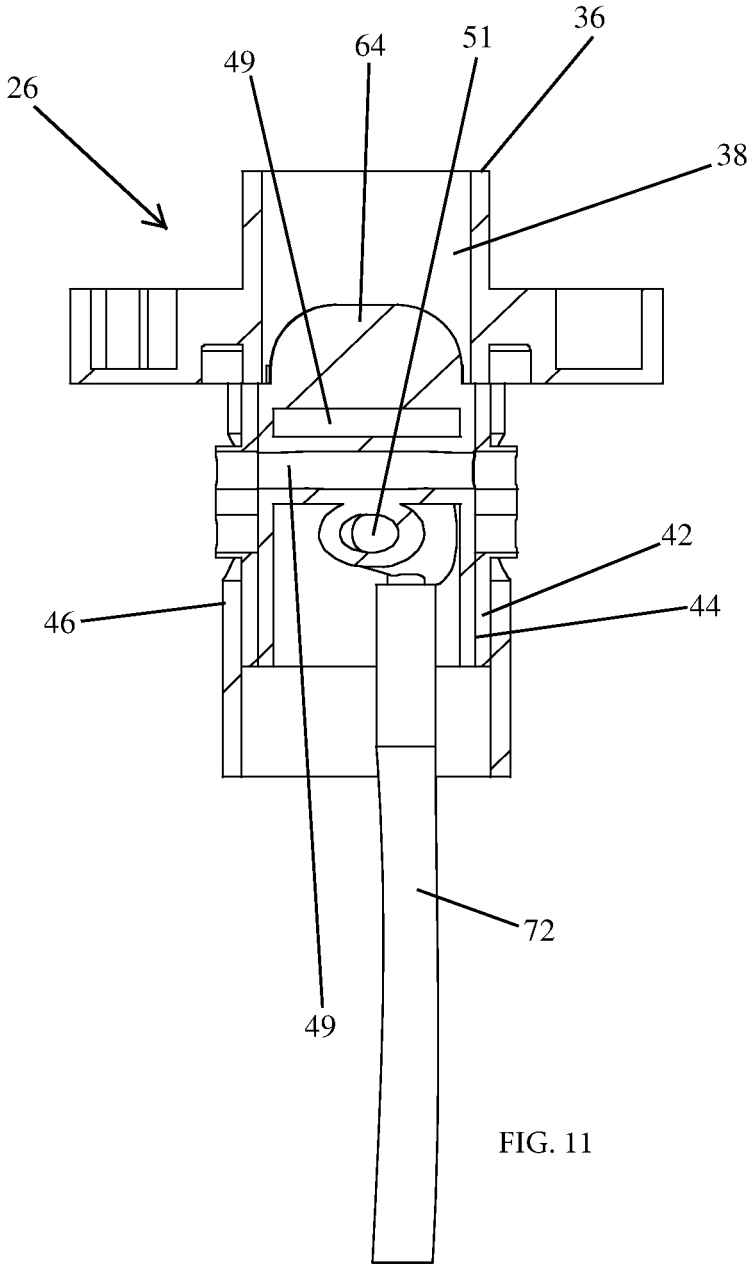
FIG. 11 is a cross-sectional view of a chamber assembly showing the flow position of the second conduit.
Figure 12:
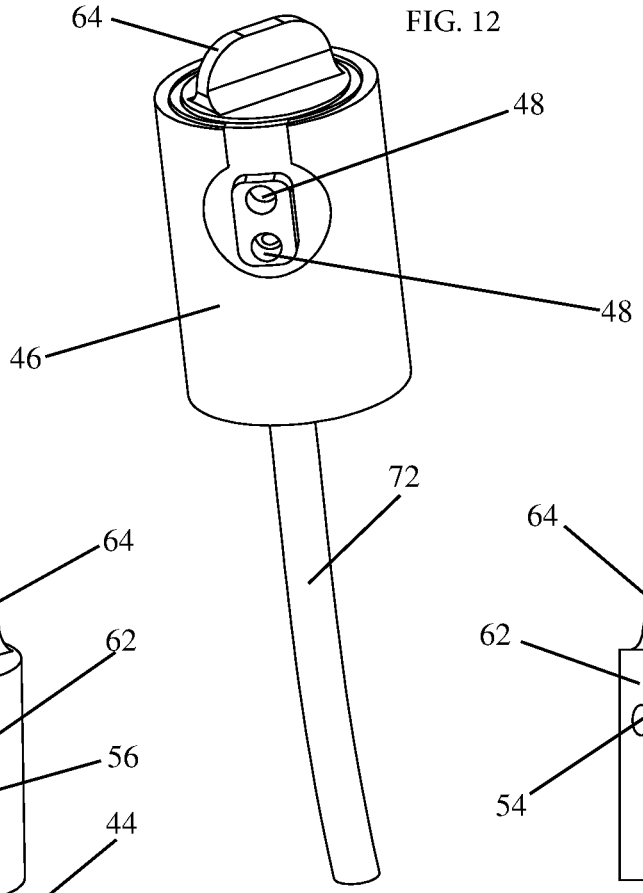
FIGS. 12-14 illustrate a chamber assembly and the flow positions of the second conduit.
Figure 13:
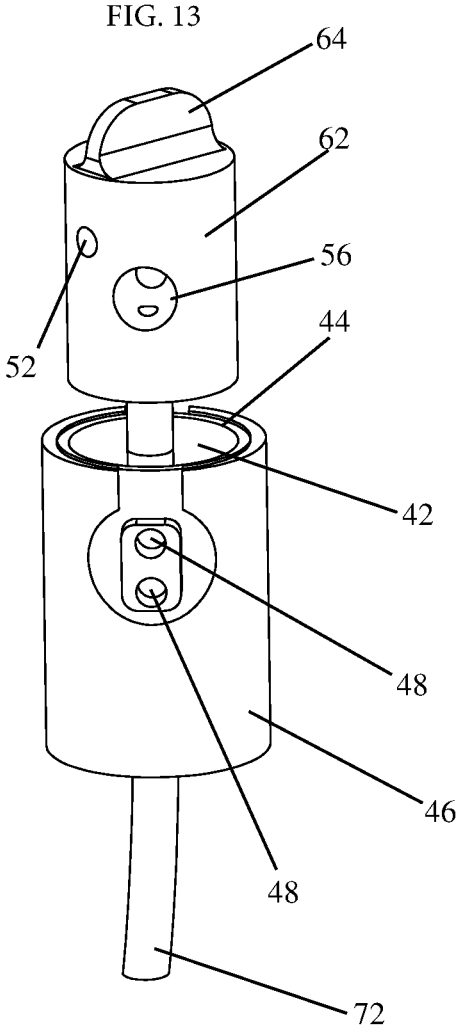
Figure 14:
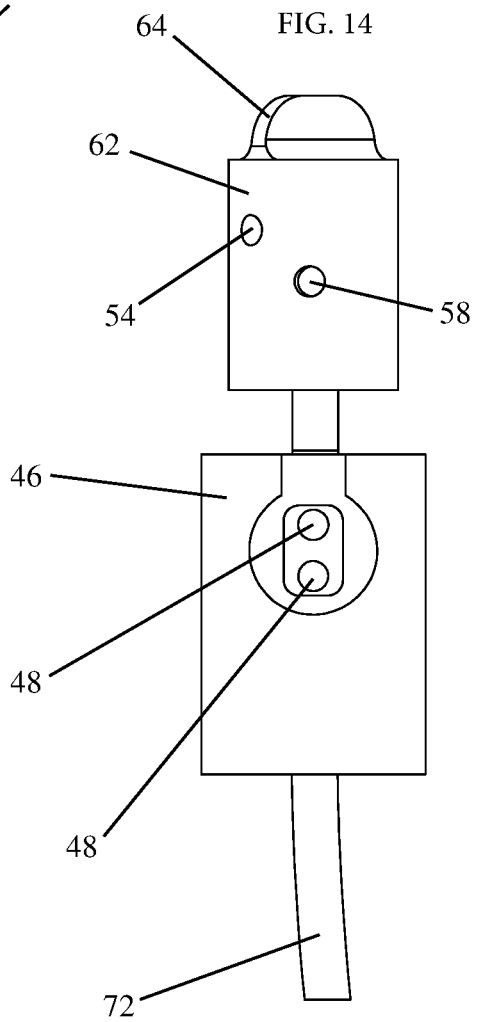

For example, and without limitation, FIGS. 1-17 show the multi-purpose sprayer 10 according to one embodiment of the present disclosure having at least one connection 12 for providing a first liquid product 14 and at least one supply canister 16 for holding a second liquid product 18 to be dispensed with the first liquid product 14 to create a mixture 22. The multi-purpose sprayer 10 comprising the at least one connection 10 being connected to a liquid supply 24. The multi-purpose sprayer 10 having a spray head body 26, a passage 28 traversely extending through the spray head body 26 for connection to the liquid supply 24 at an inlet 32, an outlet 34 for the release of the first liquid product 14 and mixture 22, a chamber assembly 36 being centrally attached therein, and an actuator 38.

The chamber assembly 36 comprising an interior 42, an exterior housing 46 with a plurality of liquid vent openings 48 for positioning the front through-hole 52 and back through-hole 54 of a first conduit 49 and the front through-hole 56 and the back through-holes 58 of a second conduit 51 of a valve 62 that is rotatably positioned therein, an over-cap 64 for enclosing the valve 62 for rotation thereof in the chamber assembly 36.

A first liquid product 14 enters and flows to the back through-hole 54 of the first conduit 49 for release through the outlet 34. The second conduit 51 having a constricted front region 66 being connected to the front through-hole 56 through which the first fluid enters and flows to a back region 68 being formed at an acute angle to said constricted front region 66. The back region 68 being connected to at least one siphon hose 72 having first 74 and second openings 76 and wherein the first opening 74 of the siphon hose 72 is coupled to the back region 68 of the second conduit 51 for introducing the second liquid product 18 into the second conduit 51 and thereby creating the mixture 22 of the first liquid product 14 to the second liquid product 18 in the back region thereof 68. Wherein the mixture 22 flows to a back through-hole 58 connected to the back region 68 for release of the mixture 22 through the outlet 34.

The actuator 38 is manually actuable in a first flow position 78 for selecting the flow of a first liquid product 14 and a second flow position 82 for selecting the flow of the first liquid product 14 and the mixture 22 by rotating an over-cap 64. Indicia 84 are provided on the actuator 38 corresponding to the first flow position 78 and the second flow position 82.

The supply canister 16 having a top receiving hole for receiving the spray head body 26, a plurality of retaining ribs 88 extending around the top receiving hole 86 of the canister 16 for securing the spray head body 26 and the supply canister 16 being configured to contain the first liquid product 14 and the mixture 22.

The exterior housing 46 and the valve 62 are cylindrical in shape and are in frictional engagement. The interior 42 of the chamber assembly 36 is configured to simultaneously block the first 52 and the second through-hole 54 of the first conduit 49 while the second conduit 51 is in use and wherein the interior 42 of the chamber assembly 36 is configured to simultaneously block the first through-hole 56 and the second through-hole 58 of the second conduit 51 while the first conduit 49 is in use.

The first conduit 49 and the second conduit 51 of the valve 62 are sequentially positioned at a first flow position 78 and a second flow position 82 at the plurality of liquid vent openings 48 to create a desired flow and spray pattern. The flow of the first liquid product 14 from the first conduit 49 and the flow of the mixture 22 from the second conduit 51 are reversed by manually turning the actuator 38 and thereby rotating the over-cap 64. The first conduit 49 and the second conduit 51 of the valve 62 have a vertical orientation and are lying in mutual perpendicular planes in the valve 62. This semi-stacked configuration in the valve 62 housing permits a flow of the first liquid product 14 in the first conduit 49 to the second conduit 51 while the constricted front region 66 and the back region 68 thereof of the second conduit 51 are sealed and pressed against the interior surface 44 of the chamber assembly 36. The first conduit 49 and the second conduit 51 of the valve 62 are operative to sequentially receive the first liquid product 14 and the mixture 22 respectively when the first liquid product 14 and the mixture 22 flows therethrough.

The angular placement of the back region 68 of the second conduit 51 creates a conical shaped second section having an entry end that is connected to the outflow end of the restricted front region. This constricted front region 66 functions as a venturi tube having a narrower internal circumference than the back region 68 and therefore a first liquid product 14 is introduced into the back region 68 at a higher pressure and thereby drawing up the second liquid product 18 therein. With conventional positioning, venturi tubes can achieve the mixing efficiency of 8 parts liquid to 100 Parts Water (8%). The efficiency of the venturi tube will vary with the container design and the sizes of the constricted front region 66 and the back region 68 of the second conduit 51.

The over-cap 64 of the valve 62 is an axis centralized axis thereto and thereby allows the first conduit 49 and the second conduit 51 to be independently selectable from the actuator 38 and shiftable from the liquid vent openings 48 of the chamber assembly 36. The first flow position 78 of the actuator 38 is configured to simultaneously retain the first through-hole 56 and the second through-hole 58 of the second conduit 51 in the interior 42 of the chamber assembly 36 and enable the flow of the first liquid product 14 through the first conduit 49. Wherein the second flow position of the actuator 38 is configured to simultaneously retain the first 52 and second through-hole 54 of the first conduit 49 in the interior 42 of the chamber assembly 36 and enable the flow of the mixture 22 through the second conduit 51.

Function and Appealing Features

To use the present disclosure, the user can turn an on/off lever connected to the multi-purpose sprayer 10 into an open position to allow the first liquid product 14 to flow as desired after selecting a first flow position 78 or a second flow position 82 on the actuator 38. A first flow position 78 directing a first liquid product 14 into the first conduit 49 or a second flow position into the second conduit 51 is thereby selectable to mix the first and the second liquid product 18 for use in fertilizing, cleaning automobiles, structural cleaning, or any other cleaning pursuits that requires liquid products to be mixed. Various types of actuator sub-assemblies can be used and it is desirable to provide an actuator 38 which is firm, durable in construction, simple to operate, and efficient.

Preferably, the chamber assembly 36 may be formed of rigid, distortable, shape-resuming, and durable plastic material such as styrene or polyurethane. The material must be designed to withstand expansion from water pressure and to withstand the same to provide the venturi effect in the constricted front region 66 of the second conduit 51.

The inventor is suggesting the multi-purpose sprayer because it would fulfill the need for a modified multi-purpose sprayer 10 with a plurality of conduit capacity to spray a first product or a mixture of products. The appealing features of the multi-purpose sprayer 10 would be its proficiency of use, convenience, functionality, safety, and efficiency provided for the end user. The overall size, all parts and componentry sizes, shapes, configuration, material composition, dimensions, and indicia applications would be developed during the design and engineering phases, prior to manufacture.

The potential exists for varying the production of the multi-purpose sprayer 10 in ways, which could make it more appealing to a wider range of end users. This could include producing the multi-purpose sprayer 10 with various types of materials and additional conduits to the increase overall size and use of the sprayer.

It appears that the multi-purpose sprayer 10 may be produced easily using conventional and readily available materials and manufacturing processes. No new production technology would be required.

In the event that the multi-purpose sprayer 10 is manufactured, packaging will be required. Developing a package for a new product involves numerous considerations. Requirements for packaging can be highly variable.

Having described my invention, however, many modifications thereto will become apparent to those skilled in the art to which it pertains without deviation from the spirit of the invention as defined by the scope of the appended claims. Although the invention has been explained in relation to its preferred embodiment, it is to be understood that many other possible modifications and variations can be made without departing from the spirit and scope of the invention.

What is claimed is:

1. An improved multi-purpose sprayer having at least one connection for providing a first liquid product and at least one supply canister for holding a second liquid product to be dispensed with the first liquid product to create a mixture, the multi-purpose sprayer comprising:

the at least one connection being connected to a liquid supply;

the multi-purpose sprayer having a spray head body, a passage traversely extending through the spray head body for connection to the liquid supply at an inlet, an outlet for the release of the first liquid product and the mixture, a chamber assembly being centrally attached therein, and an actuator;

the chamber assembly comprising an interior, an interior surface, an exterior housing with a plurality of liquid vent openings for positioning a front and a back through-hole of a first conduit and a second conduit of a valve that is rotatably positioned therein, and an over-cap for enclosing the valve for rotation thereof in the chamber assembly;

the first liquid product enters and flows to the back through-hole of the first conduit for release through the outlet;

the second conduit having a constricted front region being connected to the front through-hole through which the first liquid enters and flows to a back region being formed at an acute angle to the constricted front region and the back region being connected to at least one siphon hose having first and second openings and wherein the first opening of the siphon hose being coupled to the back region of the second conduit for introducing the second liquid product into the second conduit and thereby creating the mixture of the first liquid product to the second liquid product in the back region of the second conduit and wherein the mixture flows to the back through-hole of the back region of the second conduit for release of the mixture through the outlet;

the actuator being manually actuable in a first flow position for selecting the flow of the first liquid product and a second flow position for selecting the flow of the first liquid product and the mixture by rotating the over cap;

Wherein indicia are provided on the actuator corresponding to the first and the second flow positions; and the supply canister having a top receiving hole for receiving the spray head body, a plurality of retaining ribs extending around the top receiving hole for securing the spray head body and the supply canister being configured to contain the first liquid product and the mixture.

2. The chamber assembly of claim 1 wherein the exterior housing and the valve are cylindrical in shape and are in frictional engagement.

3. The chamber assembly of claim 1 wherein the interior of the chamber assembly is configured to simultaneously block the first and the second through-hole of the first conduit while the second conduit is in use.

4. The chamber assembly of claim 1 wherein the interior of the chamber assembly is configured to simultaneously block the first and the second through-hole of the second conduit while the first conduit is in use.

5. The valve of claim one wherein the first conduit and the second conduit of the valve are sequentially positioned at the first flow and the second flow position at the plurality of liquid vent openings to spray the first liquid product and the mixture.

6. The valve of claim 1 wherein the flow of the first liquid product from the first conduit and the flow of the mixture from the second conduit are reversed by rotation of the over-cap.

7. The valve of claim 1 wherein the first conduit and the second conduit of the valve have a vertical orientation and are lying in mutual perpendicular planes in the valve.

8. The valve of claim 1 wherein the first conduit and the second conduit of the valve are operative to sequentially receive the first liquid product and the mixture respectively when the first liquid product and the mixture flows therethrough.

9. The valve of claim 1 wherein the over-cap of the valve is an axis centralized thereto that thereby allows the first and the second conduit to be independently selectable from the actuator and shiftable from the liquid vent openings of the chamber assembly.

10. The actuator of claim 1 wherein the first flow position of the actuator is configured to simultaneously retain the first and the second through-hole of the second conduit in the interior of the chamber assembly and enable the flow of the first liquid product through the first conduit.

11. The actuator of claim 1 wherein the second flow position of the actuator is configured to simultaneously retain the first and second through-hole of the first conduit in the interior of the chamber assembly and enable the flow of the mixture through the second conduit.

12. A method of dispensing a first liquid product and a mixture of the first liquid product with a second liquid product, the method comprising:

providing a multi-purpose sprayer having at least one connection for providing a first liquid product and at least one supply canister for holding a second liquid product to be dispensed with the first liquid product to create the mixture;

providing the multi-purpose sprayer with at least one connection to a liquid supply;

providing the multi-purpose sprayer with a spray head body, a passage traversely extending through the spray head body for connection to the liquid supply at an inlet, an outlet for the release of the first liquid product and mixture, a chamber assembly being centrally attached therein, and an actuator;

providing the chamber assembly with an interior, an interior surface, an exterior housing with a plurality of liquid vent openings for positioning a front and a back through-hole of a first conduit and a second conduit of a valve that is rotatably positioned therein, and an over-cap for enclosing the valve for rotation thereof in the chamber assembly;

allowing the first liquid product to enter and flow to the back through-hole of the first conduit to release through the outlet;

providing the second conduit with a constricted front region being connected to the front through-hole through which the first liquid product enters and flows to a back region being formed at an acute angle to the constricted front region and the back region being connected to at least one siphon hose having first and second openings and wherein the first opening of the siphon hose being coupled to the back region of the second conduit for introducing the second liquid product into the second conduit creating the mixture of the first liquid product to the second liquid product in the back region and wherein the mixture flows to the back through-hole of the back region for release of the mixture through the outlet;

the actuator being manually actuable in a first flow position for selecting the flow of the first liquid product and the second flow position for selecting the flow of the first liquid product and the mixture by rotating the over cap;

providing indicia on the actuator corresponding to the first and the second flow positions; and providing the supply canister with a top-receiving hole for receiving the spray head body, a plurality of retaining ribs extending around the top-receiving hole for securing the spray head body and the supply canister being configured to contain the first liquid product and the mixture.

* * * * *